US008225732B2

(12) United States Patent
Erstad et al.

(10) Patent No.: US 8,225,732 B2
(45) Date of Patent: Jul. 24, 2012

(54) METHOD FOR CONVERSION OF A TANKER

(75) Inventors: Jostein Erstad, Ask (NO); Lars Seim, Espeland (NO); Atle Ingebrigsten, Paradis (NO)

(73) Assignee: Framo Engineering AS, Bergen (NO)

( * ) Notice: Subject to any disclaimer, the term of this patent is extended or adjusted under 35 U.S.C. 154(b) by 0 days.

(21) Appl. No.: 12/278,021

(22) PCT Filed: Feb. 2, 2007

(86) PCT No.: PCT/NO2007/000036

§ 371 (c)(1),
(2), (4) Date: Dec. 31, 2008

(87) PCT Pub. No.: WO2007/089159

PCT Pub. Date: Aug. 9, 2007

(65) Prior Publication Data

US 2009/0301379 A1 Dec. 10, 2009

(30) Foreign Application Priority Data

Feb. 2, 2006 (NO) ..... 20060548

(51) Int. Cl.
*B63B 9/04* (2006.01)

(52) U.S. Cl. ..... 114/65 R; 114/77 R

(58) Field of Classification Search ..... 114/45, 114/46, 65 R, 67 R, 74 R, 77 R; 441/3, 4, 441/5

See application file for complete search history.

(56) References Cited

U.S. PATENT DOCUMENTS 3,191,201 A * 6/1965 Richardson et al. ..... 441/3
3,585,954 A 6/1971 Muto et al.
4,155,322 A * 5/1979 Hansen ..... 114/45

FOREIGN PATENT DOCUMENTS

WO WO 98/07616 2/1998

OTHER PUBLICATIONS

Va Voorst et al., "Conversion of Existing Tanker to North Sea FPSO Use." *Annual Offshore Technology Conference* 27:1(1995):301-311.

* cited by examiner

*Primary Examiner* — Lars A Olson
(74) *Attorney, Agent, or Firm* — Merchant & Gould P.C.

(57) ABSTRACT

A tanker (1) is converted to a floating production ship by a vertical opening (1) being cut out in the hull (1) and a cassette-like plate structure (7) inserted in the opening. The cassette (7) is composed of plate elements (12, 13) which are designed to fit and connect with the cut elements in the hull's opening. The cassette (7) will thereby form part of the ship's hull strength. The cassette has a vertical shaft (8) for mounting a turret (14) in/near the ship's bottom area. The turret (14) is wet-mounted in the shaft.

5 Claims, 5 Drawing Sheets

METHOD FOR CONVERSION OF A TANKER

This application is a National Stage Application of PCT/NO2007/000036, filed Feb. 2, 2007, which claims benefit of Ser. No. 20060548, filed Feb. 2, 2006 in Norway and which applications are incorporated herein by reference. A claim of priority to all, to the extent appropriate is made.

The present invention relates to offshore production of hydrocarbons with the use of a geostationarily anchored vessel. Such a vessel is anchored to the seabed via a body rotatably mounted in the vessel, a so-called turret, from which mooring cables extend to the seabed. From below the vessel risers also ascend through the rotatable body. These risers are connected to a fluid manifold mounted above the rotatable body, from which lines extend for transferring fluid to tanks on board the vessel.

An object of the present invention is to convert an existing tanker, which has a hull with a number of tanks, so that the tanker can be used in an FPSO (Floating Production System).

The object of the invention is achieved with a method for converting a tanker, such as a Suezmax, to an FPS (Floating Production Ship), which method is characterised in that a tanker is provided with a hull containing tanks, that a vertical opening is made in the hull in one or more tanks, structural elements in the hull, such as frames and stiffeners, being cut and parts in the projected opening removed, that a cassette-like structure (cassette) with plate elements is provided to fit and connect with the said cut structural elements, which cassette has a vertical, through-going shaft, that the cassette is inserted in the cut-out vertical opening in the hull and connected via the plate elements with the said cut structural elements, thereby forming a structure which is incorporated in the hull and forms part of the strength of the surrounding hull, and that a body is rotatably mounted about a vertical axis in the vertical shaft.

The advantage of the invention is considered to be that the said cassette is incorporated in the existing hull in such a manner that the strength of the hull is not impaired.

The conversion may be undertaken in a dock, a dry dock or wet dock, but may also advantageously be performed at sea, with a cofferdam mounted under the tanker's bottom at the point where the bottom of the hull is to be opened.

The vertical shaft may advantageously be provided with a lower cylindrical section and an upper cylindrical section extended relative to the lower section, which lower cylindrical section in the cassette's incorporated state will be located near or in the hull's bottom area, and that the said body is rotatably mounted in the transition between the two sections.

By mounting the said body in the transition between the two sections, far down in the hull, preferably near the hull's bottom area, the hull strength in the hull's bottom area is exploited in an advantageous manner.

At the top of the said body a fluid manifold may advantageously be located in the shaft.

This offers the possibility of mounting the fluid manifold in a protected position under the vessel's main deck, thereby providing a dry working space in the upper part of the shaft.

The invention will now be explained in greater detail with reference to the drawing, in which.

Figure 3:
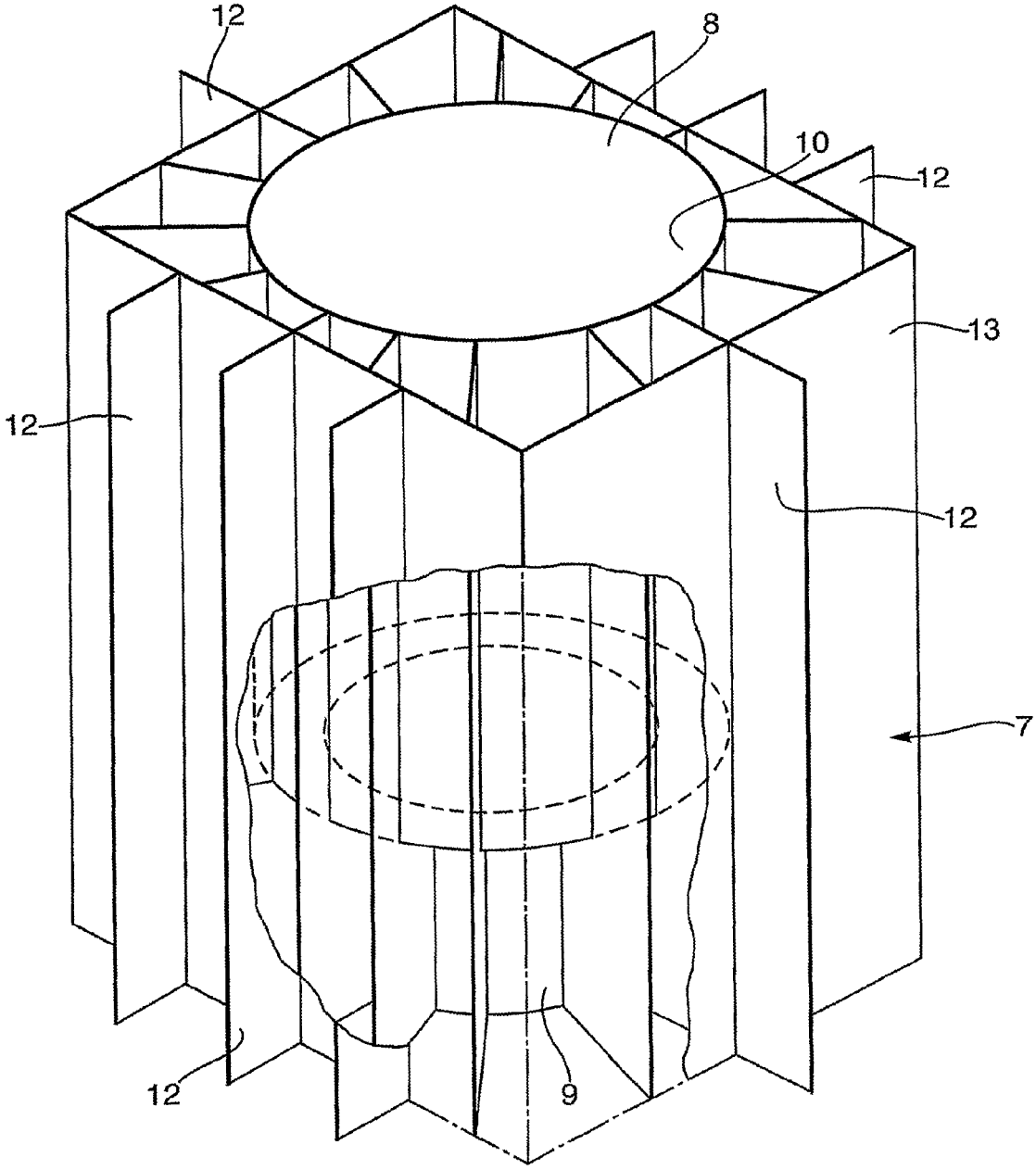
Figure 4:
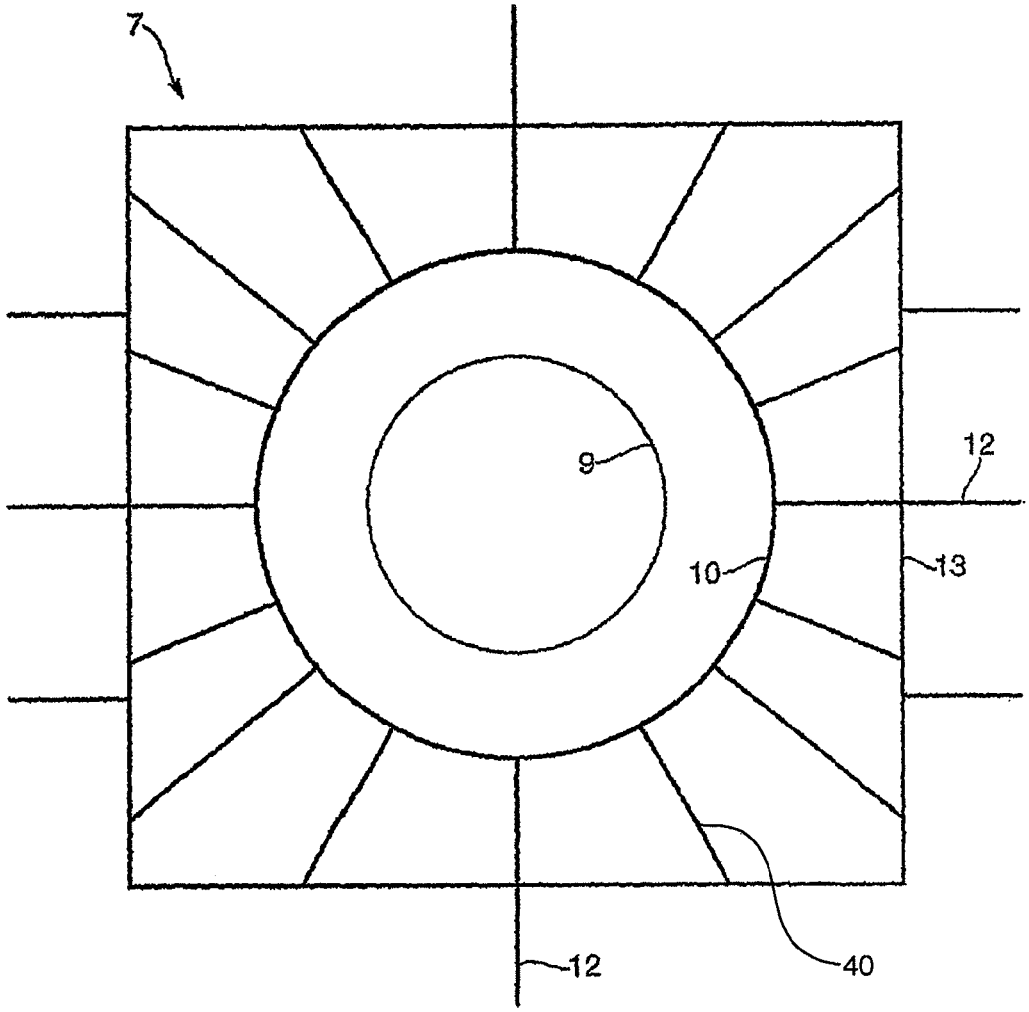
Figure 5:
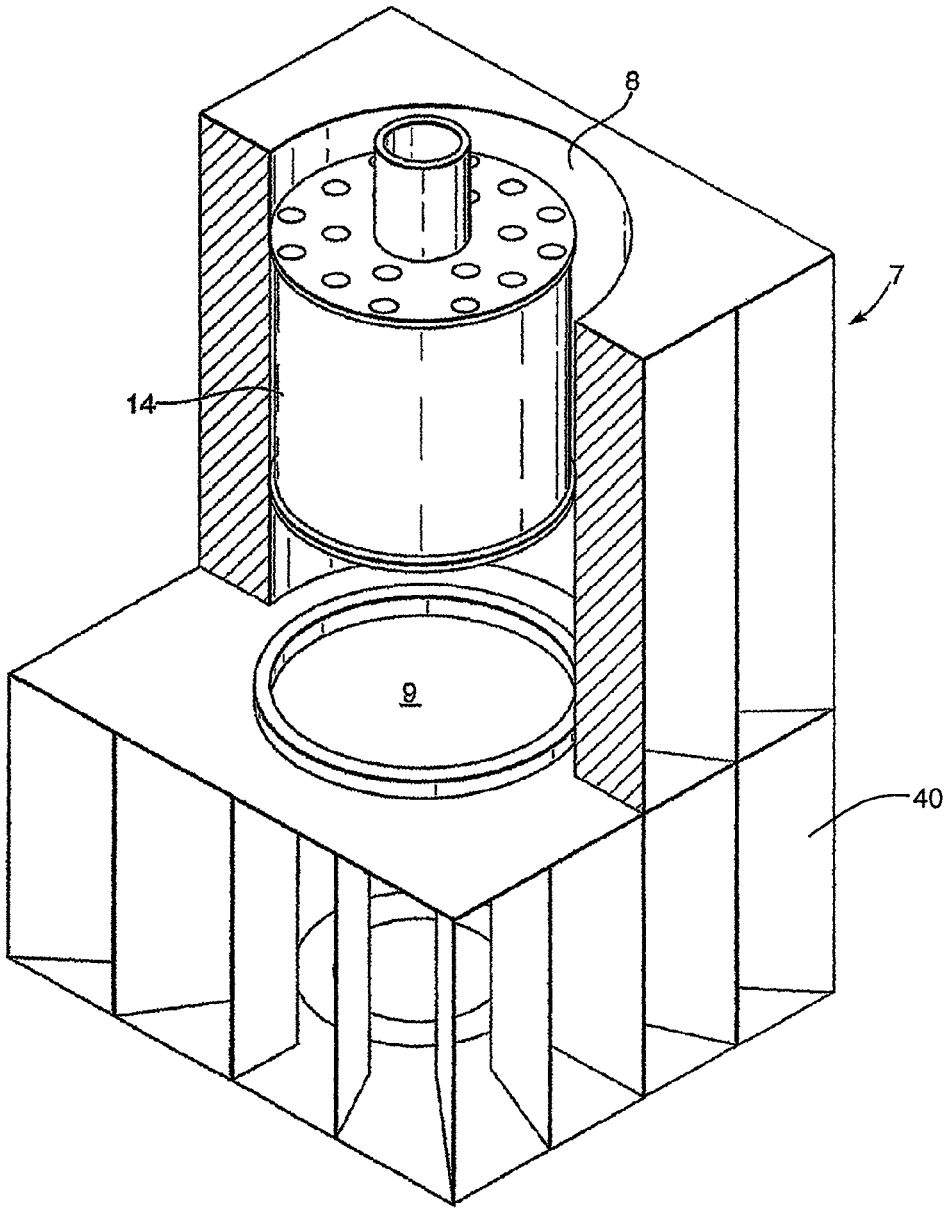
Figure 6:
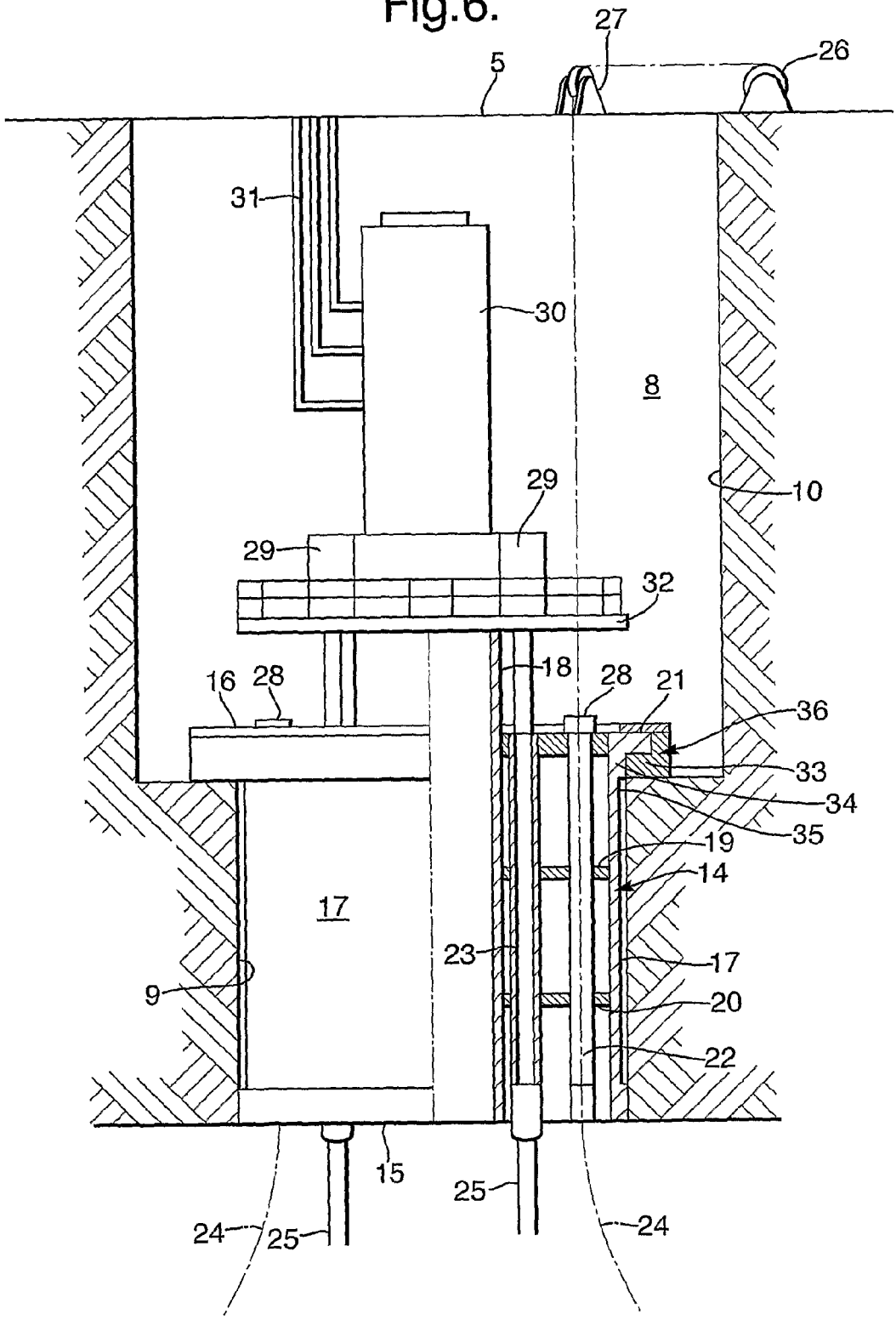

FIG. 3 illustrates a cassette-like structure (cassette) with plate elements provided to fit and connect with structural elements in the tanker, FIG. 4 is a top view of the cassette in FIG. 3, FIG. 5 illustrates insertion of a so-called turret (rotatable body) in the cassette-like structure after the cassette is incorporated in the tanker's hull (not shown), FIG. 6 is a cross section through the converted tanker with anchoring and riser arrangement.

Figure 1:
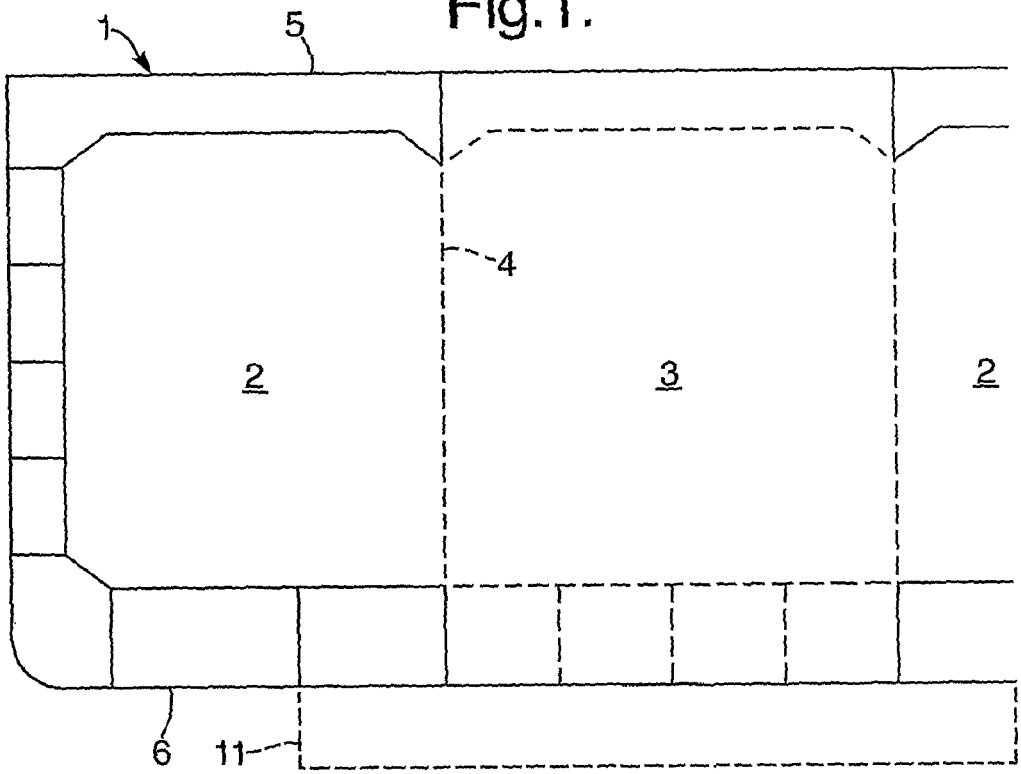
FIG. 1 is a schematic cross section through a tanker.

FIG. 1 illustrates a cross section of a tanker 1 with side or wing tanks 2 and centre tanks 3. In the hull a vertical opening 4 is made, from the main deck 5 to the bottom 6.

Figure 2:
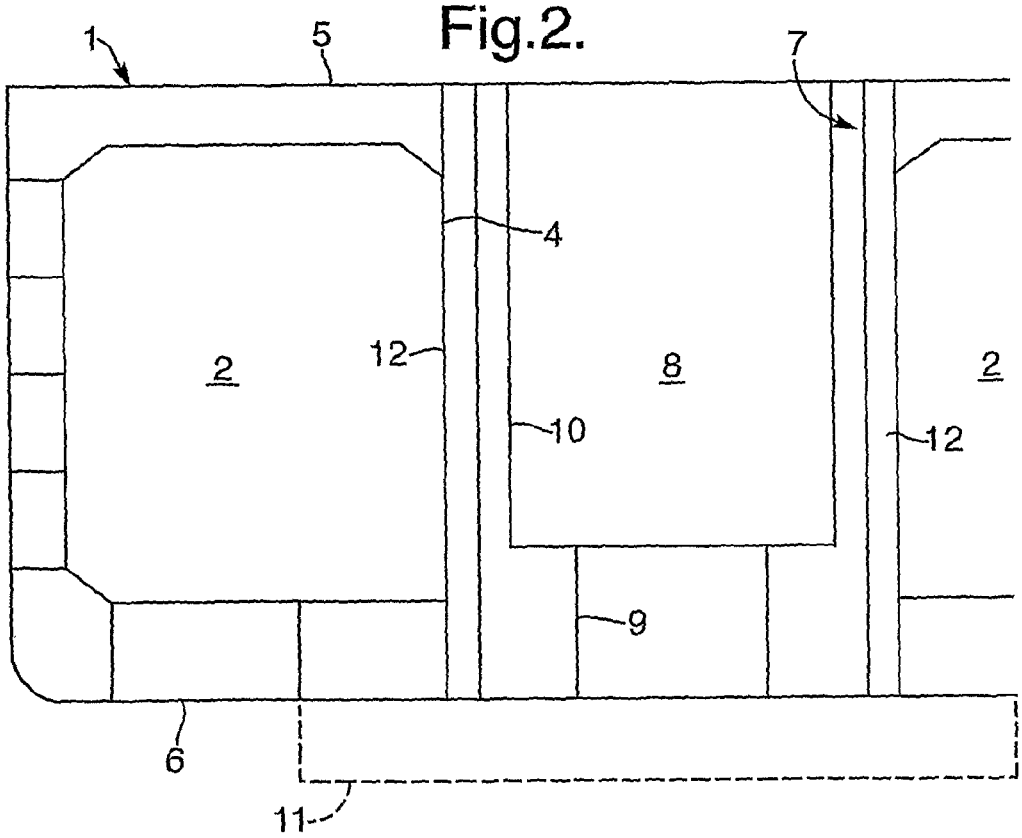
FIG. 2 illustrates the tanker in FIG. 1 with the cassette inserted.

FIG. 2 illustrates a section through the tanker 1 as in FIG. 1, in which is inserted a cassette 7, with partial engagement in the side tanks 2. Stiffeners, bracket plates, etc. are not shown.

As illustrated, the cassette 7 is constructed as a plate structure with a graduated cylindrical shaft 8, where the shaft 8 has a lower section 9 and an upper section 10. The upper section 10 has a larger diameter than the lower section 9. The cassette 7 also has structural elements in the form of plates 12, 40 and 13, see also FIGS. 4 and 5. Stiffeners etc., which will be obvious to those skilled in the art, are not shown. The plate elements, particularly the vertical plate elements 12, are intended for connection with structural elements in the vessel 1, with the result that the cassette 7 will form part of the structure of the hull. A skilled person will know that the cassette 7 can be constructed in different ways, the essential feature being that its structural elements are designed in such a manner that the cassette can be fitted into the hull and connected with its strength elements, so that the cassette will represent a strengthening part of the hull.

In FIGS. 1 and 2 a cofferdam 11 is indicated by dotted lines, whereby a dry space can be provided in the known manner under the relevant cut-out point in the hull bottom 6. This cofferdam is employed during a conversion at sea. The cofferdam 11 is removed when the cutting is completed and the cassette 7 is inserted in the hull 1. The cofferdam 11 is only illustrated in a purely schematic manner. Basically, it involves a box-shaped structure which is floated in under the bottom 6 and pumped empty of water, thereby providing a dry working area under the bottom 6 where the hull bottom 6 can be opened.

FIG. 5 illustrates how a so-called turret, i.e. the rotatable body 14, can be inserted in the shaft 8. This may be undertaken before or after the cassette 7 is incorporated in the tanker 1. The rotatable body 14 is preferably mounted after the cassette 7 is incorporated in the hull 1, for reasons of weight (crane capacity).

In FIG. 6 the rotatable body 14 is depicted set in position in the shaft 8.

The body 14 has a bottom side 15 and a top side 16 and, as illustrated in FIG. 5, is constructed as a cylindrical plate structure with an external cylinder 17 and a central stem 18 extending from the body's 14 bottom side 15 up through the top side 16. In FIG. 6 there are illustrated two horizontal annular plates 19, 20 which are welded in between the central stem 18 and the external cylinder 17. Stiffeners and other structural elements known to a person skilled in the art are not shown. The body 14 may of course be constructed in other ways which will be well-known to the skilled person.

At its top side 16 the body 14 has a flange 21. This flange 21 is used for the rotational mounting of the body 14.

In the annular space between the central stem 18 and the external cylinder 17, the body 14 has a number of casings 22, 23 provided for mooring cables 24 and risers 25 respectively.

The mooring cables 24 are tightened by means of a winch 26 on the vessel's deck 5. On the deck are mounted a number of cable guides 27 (only one is illustrated in FIG. 1), thus enabling the mooring cables 24 to be operated by one and the same winch 26. The mooring cables 24 are suspended in a manner not shown in greater detail at 28 on the body's 14 top side 16, with the result that the mooring cables do not extend up into the shaft after anchoring is accomplished.

The individual risers 25 ascend to a respective valve block 29 mounted on the top of the central stem 18. Each such valve block 29 comprises an ESO (emergency shut-off) valve.

On the central stem 18 is mounted a fluid manifold column, from which fluid lines 31 extend to the tanks on board the vessel.

Round the central stem 18 there is also provided an operating deck 32.

The space in the shaft 8 above the body's 14 top side 16 is dry. The body 14 is arranged in the tanker's bottom area, and is considered to be a wet area. Personnel can therefore carry out work in the dry space.

In the transition between the shaft's lower section 9 and the shaft's upper section 10 there is provided a packing and bearing arrangement 36, comprising an axial annular bearing and a radial annular bearing.

The packing and bearing arrangement 36 comprises a dynamic primary seal between the body's 14 flange 21 and a console 33. Above this dynamic primary seal is mounted a back-up bearing, in order to prevent the rotatable body 14 from being lifted up.

Under the flange 21 is mounted a secondary seal. This is intended to only be activated during inspection/replacement of the bearing elements. In addition there is a mounting seal.

A more detailed description of a preferred sealing and bearing arrangement for the body 14 can be found in the parallel patent application from the same applicant: "Geostationary anchoring and riser arrangement in a vessel".

The special turret arrangement in FIG. 6 is naturally only an example. Other arrangements are possible and we refer, for example, to the above-mentioned parallel patent application.

The invention claimed is:

1. A method for conversion of a tanker to a floating production ship with a geostationary anchoring and riser arrangement, wherein a tanker is provided with a hull containing tanks, the method comprising:

cutting out a vertical opening in the hull, in one or more of the tanks, and in structural elements in the hull;

providing a cassette having structural elements comprising vertical plate elements and a vertical, through-going shaft, wherein the vertical plate elements comprise first plates, second plates, and third plates, wherein the first plates are designed to fit and connect with the cut structural elements in the vertical opening in the hull such that the cassette forms part of the hull, the second plates attach to the through-going shaft, and the third plates attach the first plates and the second plates, and the vertical, through-going shaft has a lower section and an upper section wherein the upper section has a larger diameter than the lower section;

inserting the cassette in the cut-out vertical opening in the hull and connecting the vertical plate elements of the cassette with the cut structural elements in the hull, thereby forming a structure incorporated in the hull, which structure forms part of the strength of the surrounding hull; and rotatably mounting a body about a vertical axis in the vertical shaft.

2. A method according to claim 1, wherein the conversion is conducted at sea, a cofferdam being provided under the hull's bottom before the cutting operation, at point where the hull's bottom is to be opened during cutting.

3. A method according to claim 1 wherein the vertical shaft is provided with a lower cylindrical section and an upper cylindrical section, which is extended relative to the lower section, which lower cylindrical section in the cassette's incorporated state will be located near or in the hull's bottom area, and that the said body is rotatably mounted in a transition between the two sections.

4. A method according to claim 1, wherein a fluid manifold is placed on the said body, in the shaft.

5. A method according to claim 1, wherein the body, which is rotatably mounted about a vertical axis in the vertical shaft, is a turret.

* * * * *